US005390014A

United States Patent [19]

Asanae et al.

[11] Patent Number: 5,390,014

[45] Date of Patent: Feb. 14, 1995

[54] PORTABLE ELECTROPHOTOGRAPHIC IMAGE FORMING APPARATUS

[75] Inventors: Masumi Asanae, Kumagaya; Katsutomo Ohmika, Isezaki, both of Japan

[73] Assignee: Hitachi Metals, Inc., Tokyo, Japan

[21] Appl. No.: 80,521

[22] Filed: Jun. 24, 1993

[30] Foreign Application Priority Data

Jun. 26, 1992 [JP] Japan ..... 4-168124

[51] Int. Cl.[6] ..... G03G 15/20

[52] U.S. Cl. ..... 355/290; 355/210

[58] Field of Search ..... 355/200, 210, 211, 289, 355/285, 290

[56] References Cited

U.S. PATENT DOCUMENTS

| | | | |
|---|---|---|---|
| 4,829,335 | 5/1989 | Kanemitsu et al. | 355/211 |
| 4,891,294 | 1/1990 | Noguchi . | |
| 5,051,784 | 9/1991 | Yamamoto et al. | 355/285 |
| 5,159,391 | 10/1992 | Koshi et al. | 355/271 |
| 5,196,892 | 3/1993 | Mitsuaki | 355/269 |
| 5,231,453 | 7/1993 | Nakai et al. | 355/210 |
| 5,231,456 | 7/1993 | Kikuchi et al. | 355/270 |
| 5,235,386 | 8/1993 | Yano et al. | 355/219 |

*Primary Examiner*—R. L. Moses
*Attorney, Agent, or Firm*—Finnegan, Henderson, Farabow, Garrett & Dunner

[57] ABSTRACT

A light weight, portable electrophotographic printer having an image-forming unit which includes a cylindrical latent image bearing member, a device for forming the latent image, a developing device equipped with a developing roll onto which is attracted a non-magnetic one-component developer or a two-component developer containing a magnetic carrier and non-magnetic or slightly magnetic toner. The printer also has a device for transferring the developed image on the surface of the latent image-bearing member onto a recording medium, a device for cleaning the surface of the latent image-bearing member after transferring the developed image, and a device including rollers located downstream of the latent image-bearing member for heat-fixing the developed image onto the recording medium. The outer diameter of the latent image-bearing member is 40 mm or less, the outer diameter of the developing roll is 30 mm or less, and the peripheral speed of the latent image-bearing member is 60 mm/sec or less, height of the image forming unit being 60 mm or less.

6 Claims, 2 Drawing Sheets

PORTABLE ELECTROPHOTOGRAPHIC IMAGE FORMING APPARATUS

BACKGROUND OF THE INVENTION

The present invention relates to an electrophotographic printer utilizing a means for forming an electrostatic latent image on an image-bearing member, which corresponds to information to be printed, a means for developing the electrostatic latent image with a non-magnetic, one-component developer or a two-component developer containing a magnetic carrier and non-magnetic or slightly magnetic toner, a means for transferring the developed toner image to a recording medium, and a means for heat-fixing the developed toner image to the recording medium, and more particularly to an electrophotographic printer which has reduced thinness and improved portability.

In a conventional electrophotographic printer, an electrostatic latent image corresponding to a printer output (information to be printed) is generally formed on a cylindrical photosensitive drum, brought into slide contact with a magnetic brush of a magnetic developer conveyed on a developing roll containing a permanent magnet roll and disposed opposite the photosensitive drum, so that it is developed (visualized as a toner image). The developed toner image is then transferred onto a recording paper and heat-fixed.

The magnetic developer usable for a magnetic brush method as mentioned above is in many cases a two-component developer consisting of a magnetic carrier and a non-magnetic toner. However, in the case of using such a two-component developer, a concentration sensor and other members are required, failing to satisfactorily miniaturize an electrophotographic printer. Accordingly, a magnetic one-component developer, or a two-component developer consisting of a magnetic toner and a magnetic carrier is mostly used for the electrophotographic printer.

The above-mentioned developers are mostly used in a method where toners are triboelectrically charged by friction between toner particles themselves or between toner particles and a sleeve, etc. However, the development method utilizing the triboelectric charging of the toner involves the problems that the toner tends to agglomerate, and that the image quality varies with environmental conditions. Further, since the magnetic toner contains 20–70 weight % of magnetic powder such as magnetite, etc., it is inferior to the two-component developer containing non-magnetic toner in fixability.

To solve these problems, it has been proposed a developing apparatus permitting the use of one-component developer consisting only of non-magnetic toner. This kind of apparatuses are composed of a toner container which holds a toner, a cylindrical developing roll made of non-magnetic metals and rotatably disposed in the lower part of the toner container, and a blade which is made of flexible materials and has an end fixed to the toner container and the other free end being in slide contact with the developing roll. Incidentally, the developing roll is connected to a bias voltage source and disposed to oppose the photosensitive drum with some gap.

Due to the above-described construction, the toner is charged at a particular polarity by the blade, attracted onto the surface of the developing roll in a form of thin layer due to the electrostatic force, and brought into contact with the photosensitive drum as the developing roll is rotated, thereby developing an electrostatic latent image formed on the photosensitive drum.

Since the developing apparatuses employing a non-magnetic, one-component developer or a magnetic, two-component developer containing a magnetic carrier and a non-magnetic or slightly magnetic toner have a relatively simple structure, electrophotographic printers utilizing these apparatuses can be miniaturized to some extent, but there is a limit in the conventional electrophotographic printer. That is, since the conventional electrophotographic printer has a heatfixing means comprising a heat roll containing a heat source and a pressure roll for pressing the recording paper to the heat roll, and since these rolls are provided with paper-separating fingers and other accessories, it is impossible to reduce the height of the roll pair of the heat-fixing means drastically. Accordingly, it has been impossible to make the conventional electrophotographic printer have an extremely reduced thickness.

However, demands for a portable (hand-carrying) electrophotographic printer as well as for a stationary one have greatly increased recently. Although such a portable electrophotographic printer has already been commercialized for a type of using heat-sensitive papers, the information or image recorded on the heat-sensitive papers will disappear as the time goes. Accordingly, for the purpose of printing information which should be kept for a long period of time, the heat-sensitive paper type electrophotographic printer is not suitable.

OBJECT AND SUMMARY OF THE INVENTION

Accordingly, an object of the present invention is to provide a thin, hand-carrying electrophotographic printer free from the above problems inherent in the conventional electrophotographic printer.

To achieve the above object, the electrophotographic printer according to the first embodiment of the present invention comprises an image-forming unit composed of a cylindrical, electrostatic latent image-bearing member; an electrostatic latent image-forming means, a developing means equipped with a developing roll onto which a non-magnetic, one-component developer is attracted, a transfer means for transferring the developed image on the surface of the electrostatic latent image-bearing member onto a recording medium, and a cleaning means for cleaning the surface of the electrostatic latent image-bearing member after transferring of the developed image, respectively disposed near the electrostatic latent image-bearing member; and a fixing means disposed downstream of the electrostatic latent image-bearing member for heat-fixing the developed image onto the recording medium, wherein an outer diameter of the electrostatic latent image-bearing member is 40 mm or less, an outer diameter of the developing roll is 30 mm or less, and a height of the image-forming unit is 60 mm or less.

The electrophotographic printer according to the second embodiment of the present invention comprises an image-forming unit composed of a cylindrical, electrostatic latent image-bearing member; an electrostatic latent image-forming means; a developing means equipped with a developing roll onto which a magnetic, two-component developer containing a magnetic carrier and non-magnetic or slightly magnetic toner is attracted, a transfer means for transferring the developed image on the surface of the electrostatic latent image-bearing member onto a recording medium, and a cleaning means for cleaning the surface of the electrostatic latent image-bearing member after transferring of the developed image, respectively disposed near the electrostatic latent image-bearing member; and a fixing means disposed downstream of the electrostatic latent image-bearing member for heat-fixing the developed image onto the recording medium, wherein the developing means has a developer container which consists of a carrier chamber in which the developing roll is disposed, and a toner chamber adjoining to each other with a partition therebetween and communicating with each other via an opening positioned below the partition, and wherein an outer diameter of the electrostatic latent image-bearing member is 40 mm or less, an outer diameter of the developing roll is 30 mm or less, and a height of the image-forming unit is 60 mm or less.

DETAILED DESCRIPTION OF THE INVENTION

The present invention will be described in detail below.

[1] First embodiment (A) Developer

In the first electrophotographic printer of the present invention, a non-magnetic, one component developer is used as the developer.

Examples of binder resins contained in this non-magnetic, one-component developer include styrene resins such as polystyrene, styrene-butadiene copolymer, styrene-acrylate copolymer, styrene-methacrylate copolymer, etc., epoxy resins, polyester resins, etc., and they may be used alone or in combination.

Colorants contained in the non-magnetic, one-component developer may include known pigments and dyes such as carbon black, chrome yellow, Hansa yellow, benzidine yellow, rose rouge, aniline red, phthalocyanine blue, aniline blue, nigrosine dye, aniline black, etc. The content of such colorant is desirably 1–10 weight %.

In addition to the above binder resin and colorant, the toner of the present invention may contain a charge control agent, a releasing agent, a flow improver, a filler, etc. The charge control agents include nigrosine dye, a reaction product of nigrosine dye and a carboxylic group-containing resin, triphenylmethane dye, metal(Cr)-containing azo dye, etc. The releasing agents include polypropylene, polyethylene, paraffin wax, carnauba wax, amide wax, etc. The flow improvers include hydrophobic silica. The fillers include inorganic fine powder such as calcium carbonate, talc, clay, etc. The amounts of these additives may be determined depending upon the properties required for the toner, but generally the charge control agent is 1–5 weight %, the releasing agent 1–10 weight %, the flow improver 0.1–5 weight %, and the filler 1–10 weight %.

Incidentally, 0.01–0.4 parts by weight of the charge control agent may preferably be applied onto the surface of the toner to prevent the toner from filming to a photosensitive drum as well as to shorten the period of time consumed for the triboelectric charging.

The toner of the present invention may be produced by a known method such as pulverization, spray-drying, etc. According to a pulverization method, each starting material is ball-milled or dry-milled to provide a premixture, blended by a kneader or rolls while heating, pulverized by a jet mill, etc. after solidification and then classified. From the viewpoint of image quality, the toner may have a volume average particle size of 4–15 μm.

(B) Construction of the first electrophotographic printer

Figure 1:
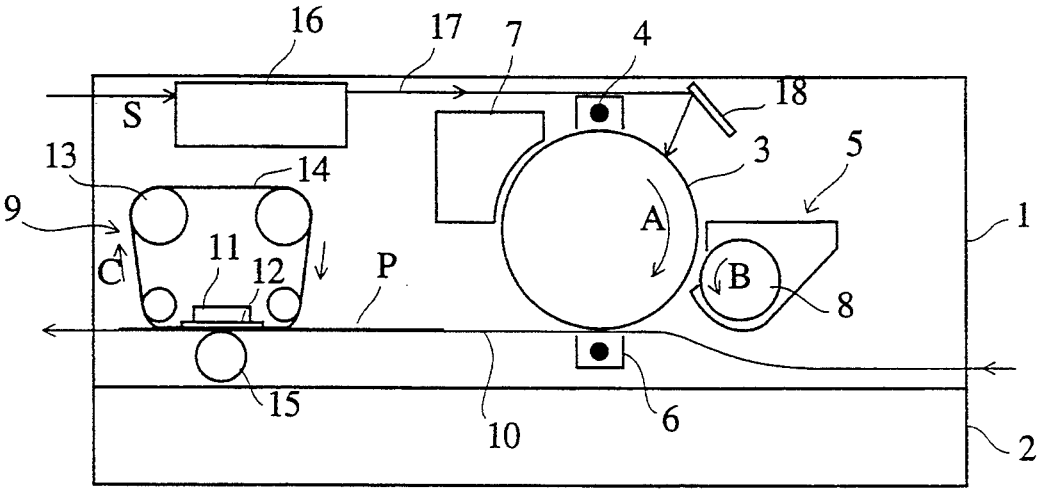
FIG. 1 is a schematic view showing an electrophotographic printer according to the present invention.
Figure 3:
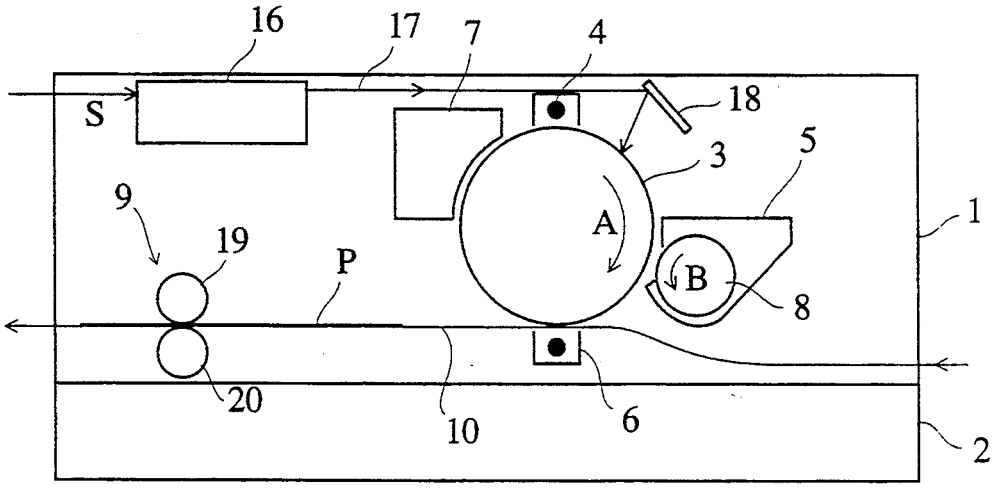
FIG. 3 is a schematic view showing another electrophotographic printer according to the present invention.

The first electrophotographic printer may have a construction shown in FIG. 1 or 3.

In the case of the first electrophotographic printer shown in FIG. 1, the image-forming unit 1 integrally mounted to a control unit 2 comprises a cylindrical photosensitive drum 3 having an outer surface coated with a photosensitive layer (not shown) made of zinc oxide or an organic semiconductor, which is rotatable in the direction shown by the arrow A. Disposed in the vicinity of an outer surface of the cylindrical photosensitive drum 3 are a corona charger 4, a developing means 5, a transfer means 6, and a cleaning means 7. The developing means 5 contains a developing roll 8 opposing the photosensitive drum 3 and rotatable in the direction shown by the arrow B.

A fixing means 9 is disposed on the downstream side of the cylindrical photosensitive drum 3 along a path 10 of a recording paper P in the image-forming unit 1. The fixing means 9 is constituted by a heating means comprising a substrate 11 made of a heat-resistant, insulting material such as alumina and a heater means 12 made of an electric resistance material and formed on the substrate 11, a plurality of rollers 13, an endless belt 14 movable along a path around the heater means 12 and the rollers 13 in the direction shown by the arrow C, and a rotatable pressure roll 15 disposed in the vicinity of the heater means 12 for pressing the recording paper P to the heater means 12 via the belt 14.

The endless belt 14 may have a thickness of 100 μm or less, preferably 20–50 μm, and may be made of a heat-resistant material such as polyimide, polyetherimide, etc. The endless belt 14 is coated with a layer having release property (not shown) made of fluoroplastics such as polytetrafluoroethylene (PTFE), perfluoroalkoxy resins (PFA), etc. at a thickness of 1–20 μm, particularly about 10 μm on the surface facing the toner image on the recording medium P (lower surface in FIG. 1). The pressure roll 15 is coated with an elastic layer (not shown) having a good release property such as a silicone rubber, etc. The pressure roll 15 may come into contact with the heater means 12 via the belt 14 and the paper P at a linear pressure of 0.1–1 kg/cm, preferably 0.5 kg/cm.

Incidentally, the belt 14 used in the electrophotographic printer of the present invention is not restricted to an endless belt, but the belt 14 may have a limited length, if it is wound around a pair of rolls apart from each other, and if these rolls are rotated in the same direction. In this case, the belt is wound around one roll while it is unwound from another roll at any time, whereby the belt moves back and forth through a gap between the heating member 12 and the pressure roll 15.

A laser scanner 16 is mounted to an upper part of the image-forming unit 1. In response to an electric signal S corresponding to information or image to be printed, the laser scanner 16 supplies a laser beam 17 toward a mirror 18, by which the laser beam 17 is reflected and impinges a surface of the cylindrical photosensitive drum 3. The driving mechanism (not shown) and the laser scanner 16 contained in the image-forming unit 1 are electrically connected to the control unit 2, so that their operations are controlled.

Figure 2:
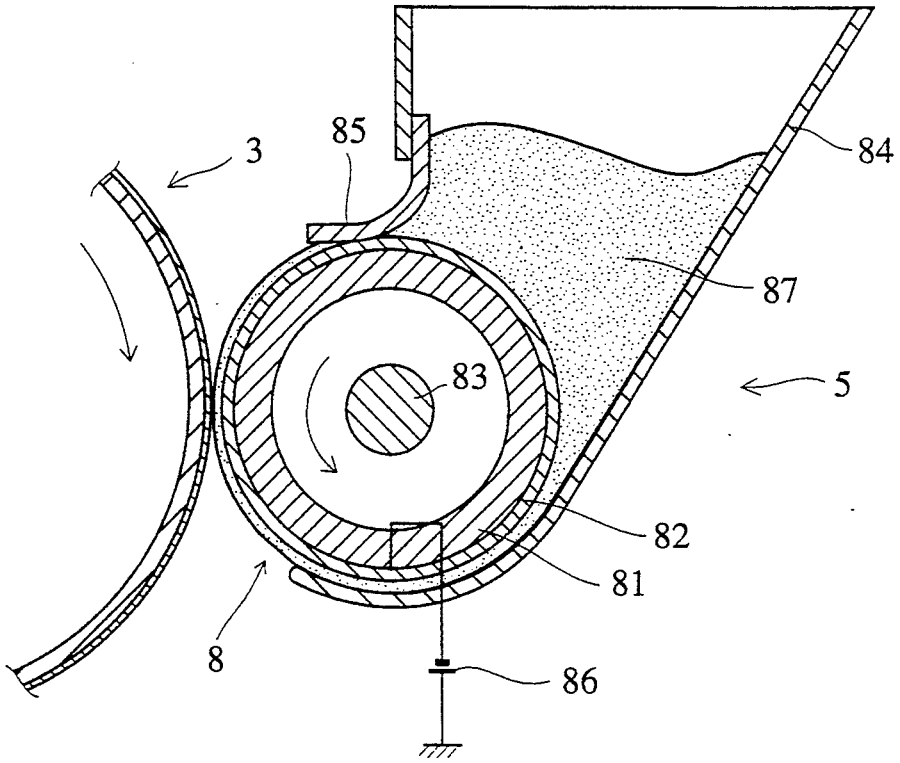
FIG. 2 is an enlarged cross-sectional view showing a developing means mountable to the electrophotographic printer according to the first embodiment of the present invention.

Since the developer used in this embodiment is non-magnetic, one-component developer, the developing means 5 has such a construction as illustrated in FIG. 2. Referring to FIG. 2, a developing means 5 comprises a developing roll 8 having a core cylindrical sleeve 81 made of non-magnetic metals such as aluminum, stainless steel, etc. and a conductive layer 82 coated on the core sleeve 81 and made of a composite material which is a phenolic resin containing 5–40 weight % of powder of carbon black dispersed therein; and the developing roll 8 is rotatably disposed in the lower part of a container 84 with a shaft 83.

85 denotes a blade member made of a flexible material and an end portion of the blade member 85 is fixed to the toner container 84 with the other end portion being in surfacial, slide contact with the conductive layer 82 of the developing roll 8. The developing roll 8 is connected to a bias voltage source 86. 87 denotes a non-magnetic, one-component developer.

Incidentally, the developing roll 8 may also be a roll made of dielectric materials such as fluoroplastics including tetrafluoroethlene-perfluoroalkylvinylether copolymer (PFA), tetrafluoroethylene-hexafluoropropylene copolymer (FEP), a roll made of conductive materials on which particles of dielectric materials applied, and a conductive or semiconductive roll made of rubbers, thermosetting resins such as phenolic resins, urea resins, melamine resins, etc., and thermoplastic resins such as polystyrenes, acrylic resins, etc., in which conductive particles such as carbon black, aluminum powder are dispersed.

When the electrostatic latent image-bearing member 3 has an outer diameter exceeding 40 mm and the developing roll 8 has an outer diameter exceeding 30 mm, the image-forming unit 1 becomes too high, whereby the electrophotographic printer cannot be made thin and portable. Therefore, the electrostatic latent image-bearing member 3 should have an outer diameter of 40 mm or less, preferably 30 mm or less, and the developing roll 8 should have an outer diameter of 30 mm or less, preferably 20 mm or less, so that the height of the image-forming unit 1 can be made as small as 60 mm or less. A peripheral speed of the image-bearing member is preferably 60 mm/sec or less, more preferably 20–50 mm/sec. Accordingly, the fixing speed is also preferably 60 mm/sec or less, more preferably 20–50 mm/sec. With these peripheral speed and fixing speed (both called "process speed"), the electrostatic latent image-bearing member 3 having as small an outer diameter as 40 mm or less can be used, and the convey speed of the developer can be suppressed, which makes it possible to reduce the outer diameter of the developing roll 8 to 30 mm or less. Therefore, a torque necessary for rotating the developing roll 8 can be reduced, which in turn makes a driving means smaller.

In one example, the height of the image-forming unit 1 can be reduced to as small as 55 mm, by reducing the outer diameter of the photosensitive drum 3 having a photosensitive layer made of an organic semiconductor to 30 mm and the outer diameter of the developing roll 8 to 18 mm. Such a small electrophotographic printer is easily carried with a hand.

The electrophotographic printer having the above structure is operated as follows:

After putting the image-forming unit 1 into an operating condition via the control unit 2, an electric signal S corresponding to information or image is supplied to the laser scanner 16. Next, the photosensitive drum 3 is charged uniformly by a charger 4, and the laser beam 17 generated by the laser scanner 16 according to the electric signal S is impinged onto the charged surface of the photosensitive drum 3 to form an electrostatic latent image. The electrostatic latent image is developed with a non-magnetic toner conveyed by the rotation of the developing roll 8 of the developing means 5. The developed image (toner image) is then transferred onto a recording paper conveyed along the recording paper path 10 by means of the transfer means 6. After transfer of the developed toner image, the non-magnetic toner remaining on the photosensitive drum 3 is removed by a cleaning means 7 having a cleaning blade (not shown), and the next electrostatic latent image is formed on the photosensitive drum 3.

The recording paper P carrying the toner image is conveyed to the fixing means 9, where the recording paper P passes through a gap between the belt 14 movable in contact with the heating member 12 and the pressure roll 15. Since heat supplied from the heating member 12 is transmitted to the toner image on the recording paper P via the belt 14, the binder resin in the non-magnetic toner is melted, whereby the toner image is fixed to the recording paper P.

In place of the above belt-type heat fixing means, the electrophotographic printer of the present invention may employ a pair roll-type heat fixing means, and perform the same electrophotographic printing operation.

A typical example of the electrophotographic printer employing a pair roll-type heat fixing means is shown in FIG. 3. In FIG. 3, the same reference numerals are assigned to the same components as in FIG. 1. The fixing means 9 is constituted by a pair of fixing rolls, namely a heating roll 19 and a pressure roll 20 both rotatable in pressed contact with each other. Each of the heating roll 19 and the pressure roll 20 has an outer diameter of 20 mm or less, preferably 10–20 mm, and they are pressed to each other at a linear pressure of 0.1–1 kg/cm, preferably 0.5 kg/cm. The heating roll 19 may be of so-called direct heat type, which is composed of a cylindrical core member made of aluminum, etc., a heating member made of an electric resistance material and formed on an outer surface of the core member, and a parting layer made of PTFE having a thickness of 1–20 μm, particularly about 10 μm. On the other hand, the pressure roll 20 may be composed of a cylindrical core member made of the same material as in the heating roll 19, and an outer layer made of a silicone rubber and formed on an outer surface of the core member.

Incidentally, the heating roll 19 may be constituted by a core member made of a ceramic material and a heating member embedded in the core member.

[2] Second embodiment (A) Developer

In the second electrophotographic printer of the present invention, a two-component developer is used as the developer. This two-component developer is a mixture of (i) a magnetic carrier, and (ii) the non-magnetic toner used in the first embodiment or a slightly magnetic toner which contains a small amount of magnetic powder in addition to the non-magnetic toner component. The addition of magnetic powder prevents the toner from scattering, and to ensure this effect, the lower limit of the amount of the magnetic powder to be added is 2 weight %. On the other hand, when it exceeds 30 weight %, the fixability of the toner decreases. Accordingly, the amount of magnetic powder to be added is 2–30 weight %, preferably 5–15 weight %. Specific examples of the magnetic powder may include compounds and alloys containing ferromagnetic metals such as iron, cobalt, nickel, etc., for instance, ferrite, magnetite, etc. Incidentally, the toner concentration of this two-component developer may preferably be set within 2–10 weight %.

The known carriers are usable as the magnetic carrier in the present invention, and among them, magnetite and soft ferrite (for instance, Ni—Zn ferrite, Mn—Zn ferrite, Cu—Zn ferrite, Ba—Ni—Zn ferrite) are preferable because of the durability and image quality. To prevent carrier adhesion and fogging, the magnetic carrier preferably has a $\sigma s$ of 40–90 emu/g (measured in a magnetic field (maximum: 10 kOe) by a sample vibrationtype magnetometer (Model VS3, manufactured by Toei Industry Co., Ltd.) and an average diameter of 20–105 μm. Also, magnetic powder coated with a resin having an average diameter of 10–100 μm may be used.

(B) Construction of the second electrophotographic printer

Both constructions shown in FIGS. 1 and 3 are also applicable to the second electrophotographic printer of the present invention. However, since the developer used in the second electrophotographic printer is of two-component type, the developing means 5 has such a construction as shown in FIG. 4.

Figure 4:
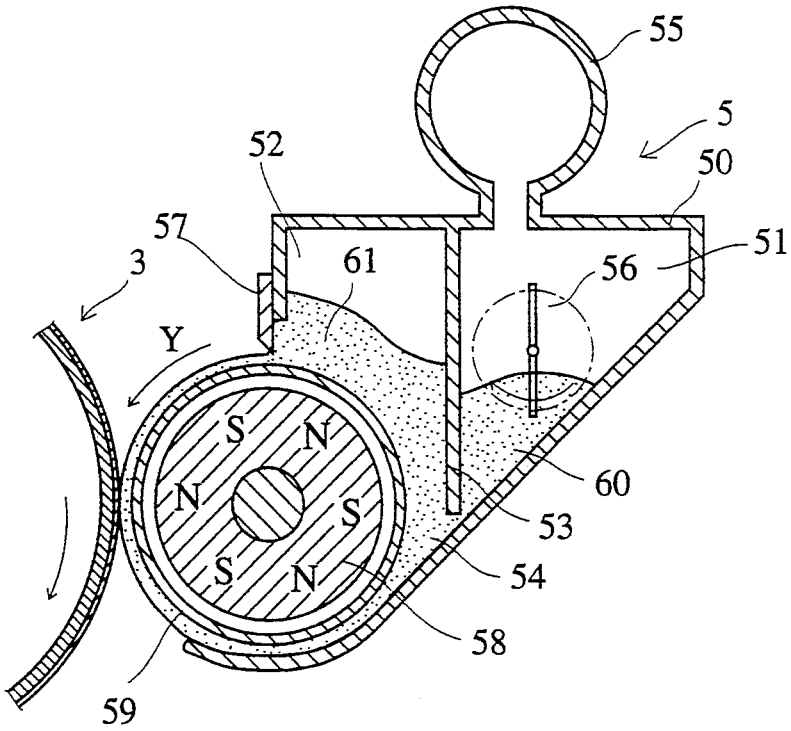
FIG. 4 is an enlarged cross-sectional view showing a developing means mountable to the electrophotographic printer according to the second embodiment of the present invention.

Referring to FIG. 4, a developer container 50 consists of a toner chamber 51 and a carrier chamber 52 adjoining to each other with a partition 53 disposed therebetween, and a opening 54 positioned below the partition 53. In the carrier chamber 52, it is disposed a developing roll 8 so that it opposes the photosensitive drum 3.

55 denotes a toner cartridge disposed above the toner chamber 51, and 56 denotes a rotatable mixing blade disposed in the toner chamber 51. A doctor blade 57 is fixed to a wall of the carrier chamber 52 and opposes the developing roll 8 with some gap which is adjustable.

In this developing means 5, the developing roll 8 may be constituted by a cylindrical permanent magnet 58 made of a sintered ferrite magnet or bonded magnet consisting of ferromagnetic powders and binders, and a hollow cylindrical sleeve 59 made of an non-magnetic material such as stainless steel. The surface of the permanent magnet 58 has a plurality of N and S magnetic poles (for example, 6 poles) in the circumferential direction, and the permanent magnet 58 is fixed so that one of the magnetic poles on the surface opposes the photosensitive drum 3, and the sleeve 59 is arranged so that it is rotated around the permanent magnet 58 counterclockwise (in the direction shown by the arrow Y). 60 denotes a non-magnetic toner or a slightly magnetic toner which further contains a small amount of magnetic powders, and 61 denotes a magnetic carrier.

Also in the second electrophotographic printer employing this kind of developing means, if the electrostatic latent image-bearing member 3 has an outer diameter exceeding 40 mm and the developing roll 8 has an outer diameter exceeding 30 mm, the image-forming unit 1 becomes too high, whereby the electrophotographic printer cannot be made thin and portable. Therefore, the electrostatic latent image-bearing member 3 should have an outer diameter of 40 mm or less, preferably 30 mm or less, and the developing roll 8 should have an outer diameter of 30 mm or less, preferably 20 mm or less, so that the height of the image-forming unit 1 can be made as small as 60 mm or less. In this embodiment too, a peripheral speed of the image-bearing member is preferably 60 mm/sec or less, more preferably 20–50 mm/sec. Accordingly, the fixing speed is also preferably 60 mm/sec or less, more preferably 20–50 mm/sec. With these peripheral speed and fixing speed (both called "process speed"), the electrostatic latent image-bearing member 3 having as small an outer diameter as 40 mm or less can be used, and the convey speed of the developer can be suppressed, which makes it possible to reduce the outer diameter of the developing roll 8 to 30 mm or less. Therefore, a torque necessary for rotating the developing roll 8 can be reduced, which in turn makes a driving means smaller.

In one example of the second electrophotographic printer, the height of the image-forming unit 1 can also be reduced to as small as 55 mm, by reducing the outer diameter of the photosensitive drum 3 having a photosensitive layer made of an organic semiconductor to 30 mm and the outer diameter of the magnet roll 8 to 18 mm. Such a small electrophotographic printer is easily carried with a hand.

The second electrophotographic printer is operated the same as the first electrophotographic printer having the developing means shown in FIG. 2, except for the developing process. The developing process with the developing means shown in FIG. 4 is as follows:

The toner 60 in the toner chamber 51 is stirred by the mixing blade 56 and brought into the carrier chamber 52 via the opening 54. Then, the toner 60 is mixed with the carrier 61 and triboelectrically charged, thereby applying to the surface of the carrier 61. On the other hand, the carrier 61 and the toner 60 thereon are attracted onto the surface of the sleeve 59 and conveyed onto the surface of the photosensitive drum 3 through the gap between the doctor blade 57 and the sleeve 59, as the sleeve 59 is rotated counterclockwise. The electrostatic latent image formed on the photosensitive drum 3 is developed accordingly.

Due to the construction shown in FIG. 4, wherein the toner and carrier can be held in adjoining chambers in a single container, the developing means can be formed thinner than the conventional developing means employing two separate containers for each of the toner and carrier.

In the developer container 50, the partition 53 prevents the carrier 61 from diffusing into the toner 60 in the toner chamber 51, thereby allowing the carrier chamber 52 to hold almost even amount of carrier continuously. In the meantime, the toner 60 is supplied into the carrier chamber 52 via the opening 54 in an amount equal to the amount of toner conveyed into a developing region opposing the photosensitive drum 3 by the rotation of the sleeve 59 due to the balance between the rotating force of the sleeve 59 and the pushing force of the toner 60 streaming into the carrier chamber 52. Owing to this mechanism, the toner concentration can be held at almost the same level once it is determined by adjusting the amount of carrier.

Example 1

77 parts by weight of styrene-acrylic copolymer (Highmer SBM 600 manufactured by Sanyo Chemical Co., Ltd.), 10 parts by weight of carbon black (#50 manufactured by Mitsubishi Kasei Kogyo K.K.), 3 parts by weight of low-molecular weight polypropylene (Bischol 550P manufactured by Sanyo Chemical Co., Ltd.), 2 parts by weight of an charge control agent (Bontron E81 manufactured by Orient Chemical Industries Ltd.), and 8 parts by weight of $CaCO_3$ (NS#2500 manufactured by Nitto Funka Kogyo K.K.) were dry-mixed, blended while heating in a kneader, pulverized by a jet mill after solidification, and then classified to provide toner of a particle size ranging 5–25 μm (average particle size: 10.5 μm). Further added to this toner was 0.2 part by weight of $SiO_2$ and dry-mixed to provide the toner usable for the present invention.

Using thus-obtained toner, electrophotographic printing was conducted by two types of the first electrophotographic printers shown in FIGS. 1 and 3 having the developing means shown in FIG. 2 (outer diameter of the photosensitive drum 3: 30 mm, outer diameter of the magnet roll 8: 18 mm, height of the image forming unit: 55 mm) under the following operating conditions:

Peripheral speed of the photosensitive drum 3=20 mm/sec.,

Fixing temperature=130° C., and

Pressing force of the pressure roll 15=0.5 kg/cm.

In both cases, the image formed on the recording paper showed good image density and resolution with good fixability.

Example 2

Using the same toner as in Example 1 as the toner and a Ba—Ni—Zn ferrite (KBN—100 manufactured by HITACHI METALS, LTD., average particle size: 74–149 μm, intrinsic volume resistance: $10^8\Omega\cdot$cm) as the carrier (toner concentration; 5 weight %), electrophotographic printing is conducted by two types of the second electrophotographic printers shown in FIGS. 1 and 3 having the developing means shown in FIG. 4 (outer diameter of the photosensitive drum 3: 30 mm, outer diameter of the magnet roll 8: 18 mm, height of the image forming unit: 55 mm) under the same conditions as in Example 1.

In both cases, the image formed on the recording paper showed good image density and resolution with good fixability.

Example 3

Example 2 was repeated except for substituting 10 parts by weight of magnetite (EPT 500 manufactured by TODA KOGYO CORP.) for the 10 parts by weight of styrene-acrylic copolymer in the same non-magnetic toner used in Example 2. In this case too, the images formed on the recording papers showed good image density and resolution with good fixability.

As described above in detail, the electrophotographic printer of the present invention can be made thin because of the above-described structure. Therefore, it is convenient as a portable printer. Also, since rollers supporting a belt or fixing rolls in the fixing means have small diameters, it is possible to prevent the recording medium from being wound around the rolls in the fixing means without using separation fingers. Therefore, the fixing means can have a simplified structure, making it possible to reduce the weight and cost of the image-forming unit.

While the described embodiments represent the preferred forms of the present invention, it should be noted that any modifications are possible unless they deviate from the scope of the present invention defined by the claims attached hereto.

What is claimed is:

1. A light-weight, portable electrophotographic printer comprising an image-forming unit having a cylindrical, electrostatic latent image-bearing member; an electrostatic latent image-forming means, a developing means equipped with a developing roll for electrostically attracting non-magnetic, one-component developer, a transfer means for transferring the developed image on the surface of said electrostatic latent image-bearing member onto a recording medium, and a cleaning means for cleaning the surface of said electrostatic latent image-bearing member after transferring of said developed image, respectively disposed near said electrostatic image-bearing member; and a fixing means including rollers disposed downstream of said electrostatic latent image-bearing member for heat-fixing said developed image onto said recording medium, wherein the peripheral speed of said electrostatic latent image-bearing member is 60 mm/sec or less, the outer diameter of said electrostatic latent image-bearing member is 40 mm or less, the outer diameter of said developing roll is 30 mm or less, and the diameters of said rollers in said heat fixing device are sufficiently small to provide finger-less release of said recording medium, the height of said image-forming unit being 60 mm or less.

2. The electrophotographic printer according to claim 1 wherein said fixing means has a pair of opposed fixing rollers each in contact with said recording medium and having a diameter of 20 mm or less.

3. The electrophotographic printer according to claim 1, wherein said fixing means has a stationary heating member, a belt disposed about said rollers and movable in contact with said heating member and said recording medium, and a pressure means disposed opposite said heating member for pressing said belt to said heating member.

4. A light-weight, portable electrophotographic printer comprising an image-forming unit having a cylindrical, electrostatic latent image-bearing member; an electrostatic latent image-forming means, a developing means equipped with a developing roll for attracting magnetic, two-component developer containing a magnetic carrier and non-magnetic or slightly magnetic toner, a transfer means for transferring the developed image on the surface of said electrostatic latent image-bearing member onto a recording medium, and a cleaning means for cleaning the surface of said electrostatic latent image-bearing member after transferring of the developed image, respectively disposed near the electrostatic image-bearing member; and a fixing means including rollers disposed downstream of said electrostatic latent image-bearing member for heat-fixing the developed image onto said recording medium, wherein said developing means has a developer container having a carrier chamber in which said developing roll is disposed, and a toner chamber adjoining to each other with a partition therebetween and communicating with each other via an opening positioned below the partition, and wherein the peripheral speed of said electrostatic latent image-bearing member is 60 mm/sec or less, the outer diameter of said electrostatic latent image-bearing member is 40 mm or less, the outer diameter of said developing roll is 30 mm or less, and the diameter of said roller in said heat fixing device are sufficiently small to provide finger-less release of said recording medium, the height of said image-forming unit being 60 mm or less.

5. The electrophotographic printer according to claim 4, wherein said fixing means has a pair of opposed fixing rollers each in contact with said recording member and having a diameter of 20 mm or less.

6. The electrophotographic printer according to claim 4, wherein said fixing means has a stationary heating member, a belt disposed about said rollers and movable in contact with said heating member and said recording medium, and a pressure means disposed opposite said heating member for pressing said belt to said heating member.

* * * * *

UNITED STATES PATENT AND TRADEMARK OFFICE

CERTIFICATE OF CORRECTION

PATENT NO. : 5,390,014

DATED : February 14, 1995

INVENTOR(S) : Masumi ASANAE et al.

It is certified that error appears in the above-identified patent and that said Letters Patent is hereby corrected as shown below:

Claim 1, col. 10, lines 17-18, "electrostically" should read --electrostatically--.

Abstract, line 1, "light weight" should read --light-weight--.

Signed and Sealed this

Second Day of May, 1995

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,390,014

DATED : February 14, 1995

INVENTOR(S) : Masumi Asanae et al.

It is certified that error appears in the above-indentified patent and that said Letters Patent is hereby corrected as shown below:

On title page, item [73] Assignee, "Inc." should read —Ltd.—

Signed and Sealed this

Eighteenth Day of July, 1995

*Attest:*

Bruce Lehman

BRUCE LEHMAN

*Attesting Officer*

*Commissioner of Patents and Trademarks*